United States Patent [19]

Visvydas

[11] 4,143,804

[45] Mar. 13, 1979

[54] PARTITION WITH INTEGRAL TIER SEPARATOR

[75] Inventor: Pranas Visvydas, Bell Gardens, Calif.

[73] Assignee: Container Corporation of America, Chicago, Ill.

[21] Appl. No.: 885,482

[22] Filed: Mar. 13, 1978

[51] Int. Cl.[2] ..... B65D 5/48

[52] U.S. Cl. ..... 229/42; 229/15

[58] Field of Search ..... 229/42, 15; 217/33, 217/34

[56] References Cited

U.S. PATENT DOCUMENTS

| | | | |
|---|---|---|---|
| 2,605,039 | 7/1952 | Deline | 229/42 |
| 2,738,917 | 3/1956 | Mader | 229/42 |
| 2,888,186 | 5/1959 | Meyers | 229/42 |
| 2,900,120 | 8/1959 | Wichman | 229/42 X |
| 3,272,328 | 9/1966 | Krzyzanowski | 229/42 X |
| 3,519,191 | 7/1970 | Royce | 229/42 |
| 3,963,171 | 6/1976 | Lindsay | 229/42 |

*Primary Examiner*—Davis T. Moorhead

*Attorney, Agent, or Firm*—Carpenter & Ostis

[57] ABSTRACT

A paperboard partition for forming a plurality of cells in separated tiers.

3 Claims, 3 Drawing Figures

PARTITION WITH INTEGRAL TIER SEPARATOR

SUMMARY OF THE INVENTION

This invention relates to paperboard partitions and more particularly to internal partition structures used for dividing a package into a plurality of separated cells or compartments.

It is desirable to provide support structure for the shipment and display of various packaged articles such as bags of candies or cookies, and it is sometimes desirable to provide various cells or compartments in a package which are located in separate tiers or layers.

It is an object of this invention to provide a unitary partition structure formed of paperboard which is used to provide a plurality of cells disposed in separated tiers.

A more specific object of the invention is to provide an integral self standing support structure which affords a plurality of internal cells in different tiers separated from each other by the structure.

These and other objects of the invention will be apparent from an examination of the following description and drawings.

THE DRAWINGS

Figure 3:
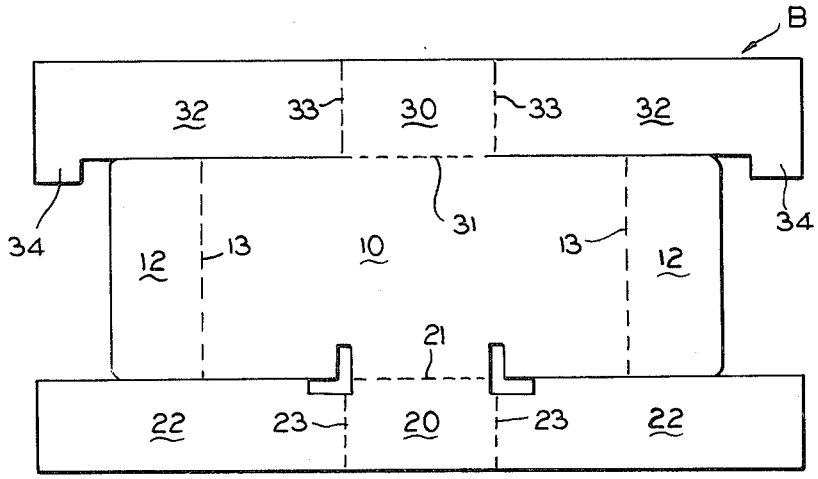
Figure 1:
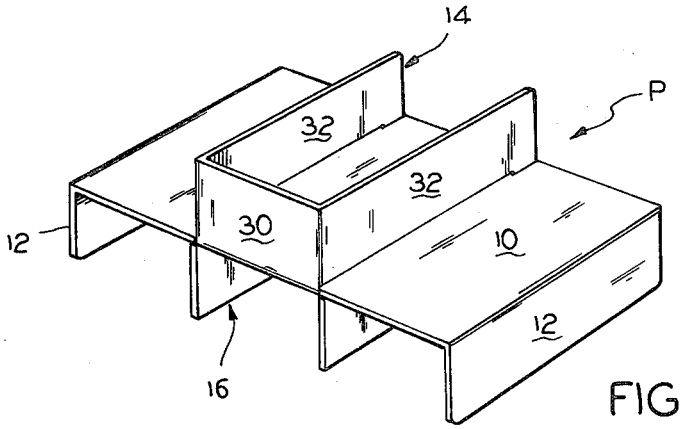
Figure 2:
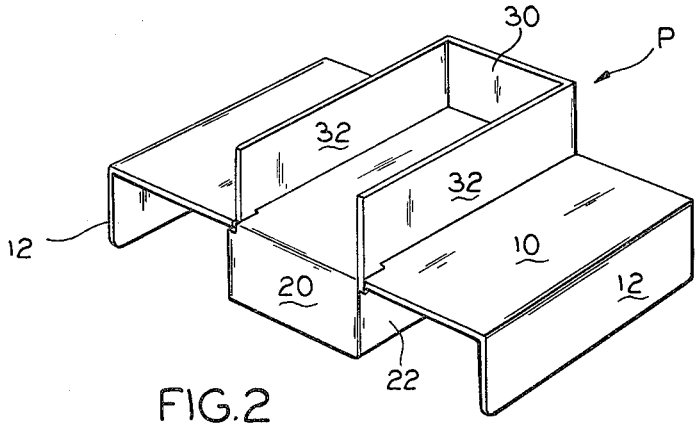

FIGS. 1 and 2 are perspective views, as seen from opposite sides, of a partition structure embodying features of the invention; and FIG. 3 is a plan view of a blank of foldable sheet material from which the structure illustrated in other views may be formed.

It will be understood that, for purposes of clarity, certain elements may have been intentionally omitted from certain views where they are believed to be illustrated to better advantage in other views.

THE DESCRIPTION

Referring now to the drawings for a better understanding of the invention, it will be seen that the partition structure, indicated generally at P in FIGS. 1 and 2, may be formed from a unitary blank B of foldable paperboard, as illustrated in FIG. 3.

Partition structure P includes a preferably rectangular, generally horizontally disposed, base or tier separator panel 10 which is supported at its ends by a pair of vertically disposed end support panels 12 which are foldably joined at their upper edges along fold lines 13 to opposed end edges of separator panel 10.

Division of the interior of a package is accomplished by a pair of generally U-shaped, vertically disposed upper and lower partition members 14 and 16, respectively, which are located intermediate the ends of panel 10 on the upper and lower sides thereof.

The partition members are of generally similar construction. Lower partition member 16 includes a minor or end panel 20 foldably joined at its upper edge along fold line 21 to a side edge of panel 10, and a pair of elongated major or side panels 22 foldably joined at corresponding end edges along fold lines 23 to opposed end edges of panel 20.

Upper partition member 14 is of generally similar construction to the lower partition member and includes a minor or end panel 30 foldably joined at its lower edge along fold line 31 to a side edge of panel 10 opposite from the side edge which is joined to panel 20 of the lower partition member. Upper partition member 14 also includes a pair of major or side panels 32 which are foldably joined at corresponding end edges along fold lines 33 to opposite end edges of panel 30.

The side panels of each partition member are folded to extend transversely of panel 10 preferably in vertical alignment with each other so as to divide the upper and lower portions of a package into three cells each, with the upper and lower portions of the package being separated from each other by the separator panel 10.

If desired, in order to afford additional stability for the structure and to maintain the upper partition member in its desired U-shape for display purposes, there may be provided at the lower free ends of upper partition member side panels 32, projections or locking feet 34 which extend downwardly and are received within slots 24 which are formed in the panel 10 and adjacent corner portions of the lower partition member 14.

I claim:

1. A partition, formed of a unitary blank of foldable paperboard, for forming a plurality of cells in separated tiers, comprising:

(a) a generally rectangular, horizontally disposed, flat, tier separator panel;

(b) a pair of support panels foldably joined at their upper edges to opposed end edges of said separator panel and extending downwardly therefrom;

(c) integral upper and lower partition members located intermediate the ends of said separator member on opposite sides thereof;

(d) each of said partition members including:

(i) an end panel foldably joined at one edge to a side edge of said separator panel and folded normal thereto;

(ii) a pair of side panels having corresponding end edges foldably joined to opposed end edges of said end panel and folded to extend normal to the respective planes of said end panel and said separator panel;

(e) at least one of said side panels of said upper partition member having a locking foot projecting downwardly from the free end of said panel.

2. A partition as defined in claim 1, wherein said separator panel has an aperture adapted to receive said locking foot.

3. A partition as defined in claim 2, wherein said locking foot is received in said aperture for maintaining said upper partition in a predetermined position.

* * * * *